US007775396B2

(12) United States Patent
Xu

(10) Patent No.: US 7,775,396 B2
(45) Date of Patent: Aug. 17, 2010

(54) AUTOMATIC SHOE COVER DISPENSER

(76) Inventor: Liang Jie Xu, Floor 2, Unit 3, Building 16, Government Buildings, Xi Zheng Street, Hanchuang City, Hu Bei Province (CN) 432300

( * ) Notice: Subject to any disclaimer, the term of this patent is extended or adjusted under 35 U.S.C. 154(b) by 588 days.

(21) Appl. No.: 11/729,590

(22) Filed: Mar. 28, 2007

(65) Prior Publication Data

US 2008/0237277 A1 Oct. 2, 2008

(51) Int. Cl.
*B65H 3/00* (2006.01)

(52) U.S. Cl. ..... 221/191; 221/171; 221/232; 223/111; 223/112

(58) Field of Classification Search ..... 221/171, 221/191, 232; 223/111, 112
See application file for complete search history.

(56) References Cited

U.S. PATENT DOCUMENTS 3,775,793 A * 12/1973 Casavant et al. ..... 12/1 R
4,616,428 A * 10/1986 Leger ..... 36/7.1 R
6,543,075 B2 * 4/2003 Gultekin et al. ..... 12/1 R

* cited by examiner

*Primary Examiner*—Gene Crawford
*Assistant Examiner*—Timothy R Waggoner
(74) *Attorney, Agent, or Firm*—Raymond Y. Chan; David and Raymond Patent Firm

(57) ABSTRACT

An automatic shoe cover dispenser includes a shoe cover feeding arrangement holding a plurality of shoe covers each having a shoe opening, a shoe cover pulling mechanism and a driving mechanism. The shoe cover pulling mechanism is capable of pulling one of the shoe covers from the shoe cover feeding arrangement as a standby shoe cover for being ready for wearing on a shoe of a user. The driving mechanism includes a pedal arranged in up and down movable manner for the shoe of the user to step thereon and a device for driving the pulling mechanism to deliver the standby shoe cover to the pedal and enlarging the shoe opening of the standby shoe cover to be large enough for the shoe of the user to place inside the standby shoe cover by means of up and down movements of the pedal.

20 Claims, 10 Drawing Sheets

AUTOMATIC SHOE COVER DISPENSER

BACKGROUND OF THE PRESENT INVENTION

1. Field of Invention

The present invention relates to a shoe cover machine, and more particularly to an automatic shoe cover dispenser.

2. Description of Related Arts

Automatic shoe cover machine is a device designed to solve the problem of having people to change their shoes before entering a room under sanitary control, wherein the user is merely required to have his or her foot with the shoe on it to step on the automatic shoe cover machine, then a shoe cover will automatically be shredded and wrapped up his/her shoe. Currently, automatic shoe cover machines are widely used in public health establishments, like hospital, laboratory, living room and other sanitation environments.

A conventional automatic shoe cover machine invented by the applicant of this application in 2000, generally uses shoe cover which has four fitting pins. The shoe covers are disposed in the machine by mounting the four fitting pins on the machine one by one. The difficulty of mounting the shoe covers on the shoes resulting in inconvenience and impractical use. Another conventional automatic shoe cover machine invented by the applicant does overcome disadvantages of the prior art machine by mounting the shoe covers on the machine without fitting pins while it is controlled by computer. However, due to the use of computer control, it has a relatively high cost that fails to meet the market demand. It is not suitable for the general consumes. At the same time, the lack of fitting pins leads to an unstable work process of the machine.

SUMMARY OF THE PRESENT INVENTION

A main object of the present invention is to provide a stable and efficient automatic shoe cover dispenser which mechanical structure ensures a stable and efficient working process.

Another object of the present invention is to provide an automatic shoe cover machines providing innovative shoe covers for users through stable and efficient working procedures that effectively prevents the conventional shortcomings such as complicated shoe cover installations and high manufacture cost.

Another object of the present invention is to provide an automatic shoe cover dispenser, which uses exclusive shoe covers, which can be steadily hanged on a shoe cover bar without complex operations, even the former shoe covers have not be completely dispensed.

Another object of the present invention is to provide an automatic shoe cover dispenser, which is simple in structure with inexpensive manufacture and maintenance cost.

Accordingly, in order to accomplish the above objects, the present invention provides an automatic shoe cover dispenser, comprising:

a shoe cover feeding arrangement holding a plurality of shoe covers each having a shoe opening;

a pulling mechanism which is capable of pulling one of the shoe covers from the shoe cover feeding arrangement as a standby shoe cover for being ready for wearing on a shoe of a user; and a driving mechanism, comprising a pedal arranged in up and down movable manner for the shoe of the user to step thereon and means for driving the pulling mechanism to deliver the standby shoe cover to the pedal and enlarging the shoe opening of the standby shoe cover to be large enough for the shoe of the user to place inside the standby shoe cover by means of up and down movements of the pedal.

According to the present invention, the shoe opening of each of the shoe cover has an elastic peripheral edge provided therearound. The driving mechanism is constructed in a manner that when a downward force is applied to the pedal to press the pedal downward, the pulling mechanism is actuated to deliver the standby shoe cover above the pedal and the shoe opening is enlarged by applying a separating force to move the elastic peripheral edge apart by the driving mechanism. Then, the pedal is driven upwards again by the driving mechanism. When the pedal is pressed downward again, the standby shoe cover is detached from the shoe cover feeding arrangement and the separating force applied to the elastic peripheral edge is released by means of the driving mechanism for wearing the standby shoe cover on the shoe of the user that steps on the pedal to press the pedal to move up and down.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Referring to FIGS. 1 to 10 of the drawings, an automatic shoe cover dispenser, according to a preferred embodiment of the present invention is illustrated, in which the automatic shoe cover dispenser comprises a frame 1, a plurality of shoe covers 5 which are ready for being worn on a shoe of a user, a shoe cover pulling mechanism A1 adapted for pulling out the shoe covers 5 into a standby condition for being ready for putting on user's shoe, i.e. wrapping up the shoe, a driving mechanism A2 adapted for driving the shoe cover pulling mechanism A1 and a shoe cover feeding arrangement A3 adapted for feeding shoe covers 5.

Figure 1:
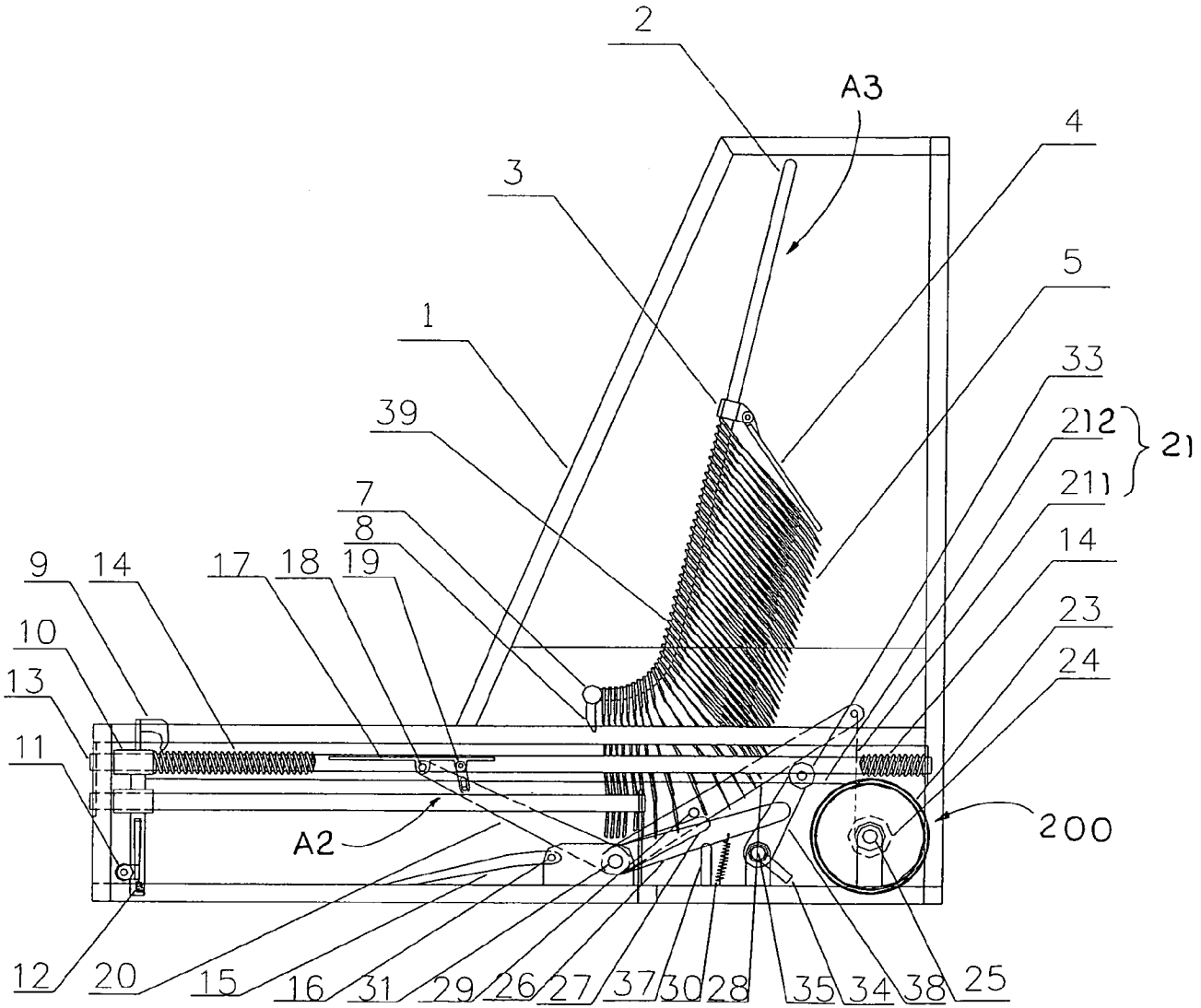
FIG. 1 is a perspective view of an automatic shoe cover dispenser according to a preferred embodiment of the present invention.
Figure 2:
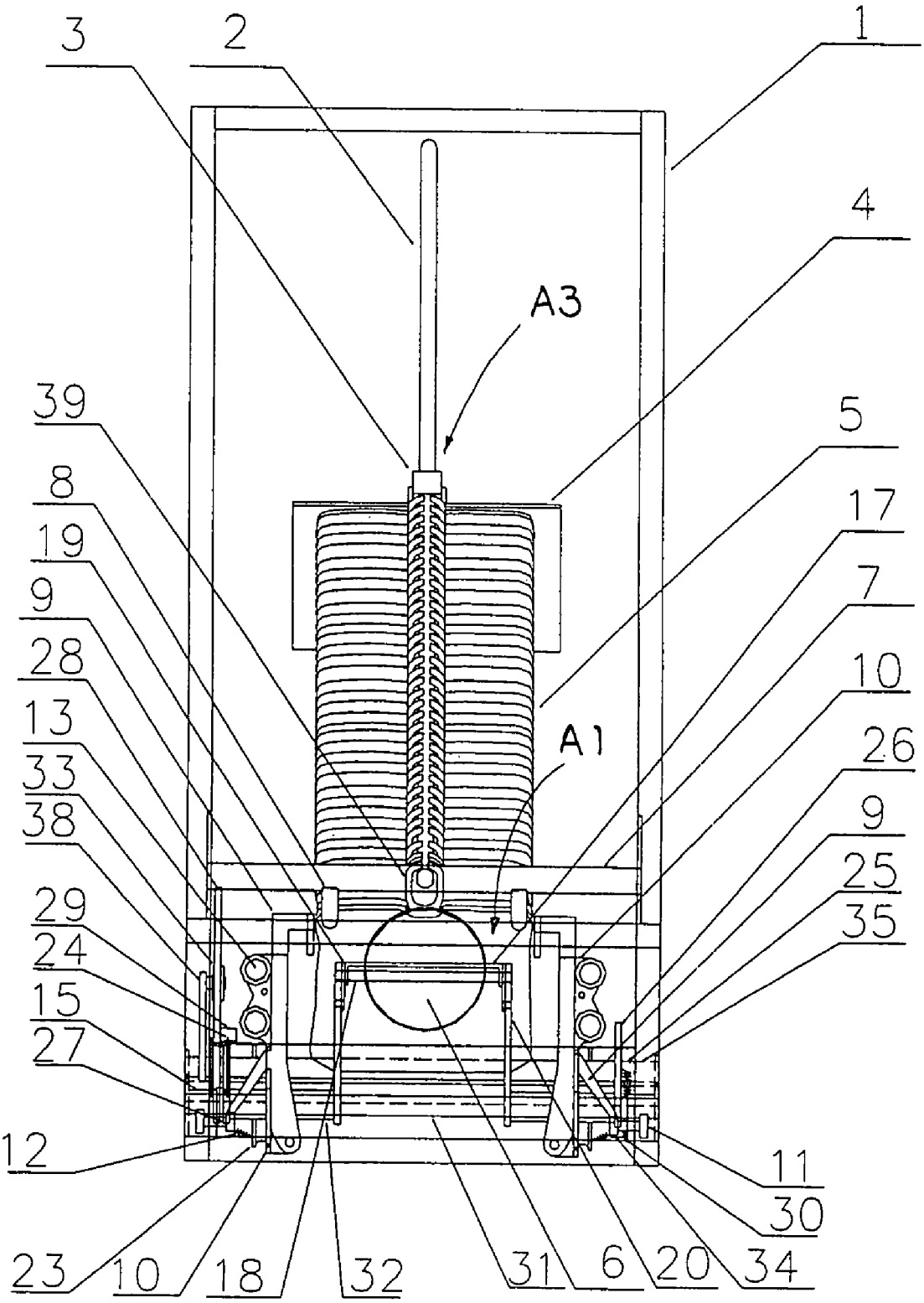
FIG. 2 is a side sectional view of the automatic shoe cover dispenser according to the above preferred embodiment of the present invention.
Figure 3:
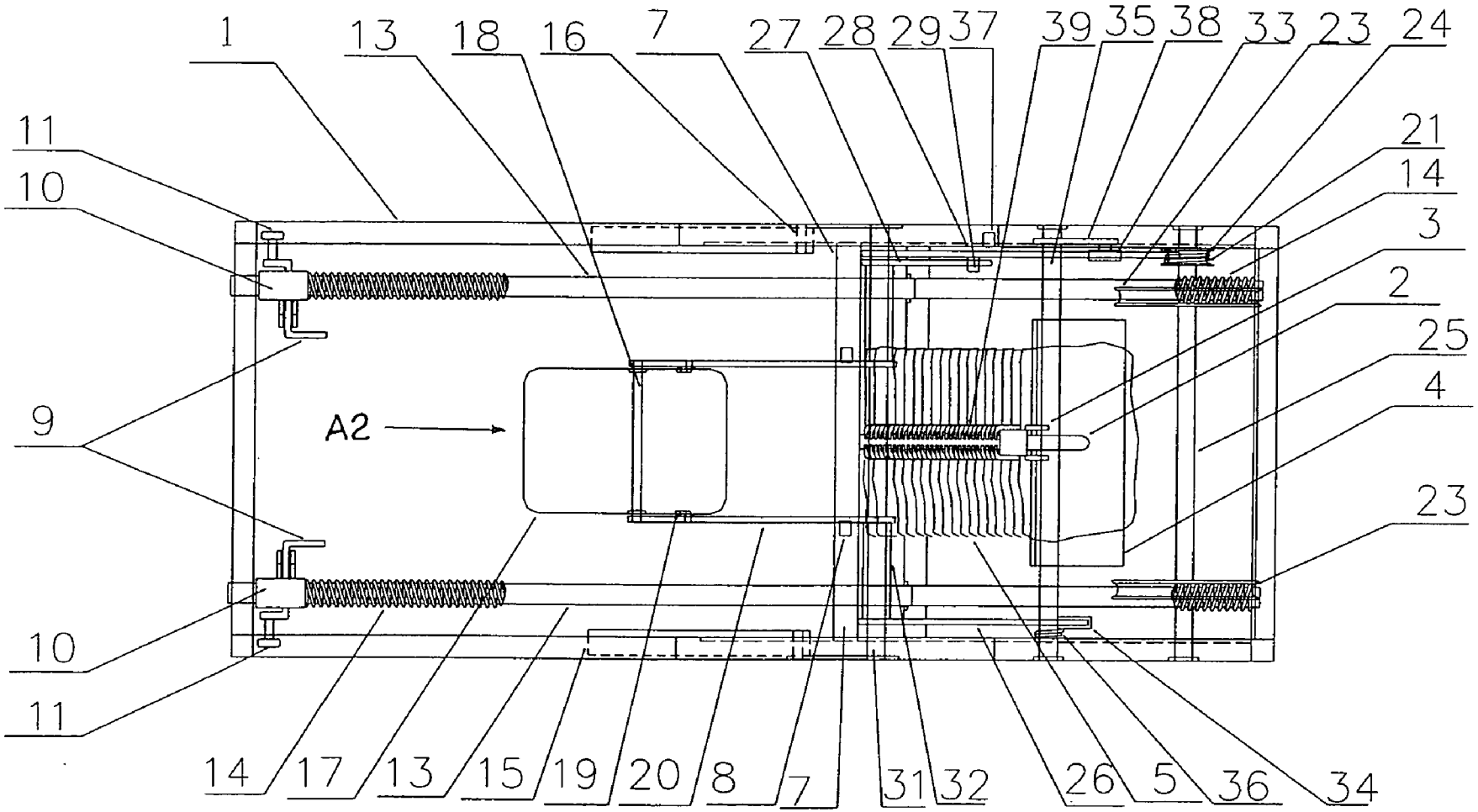
FIG. 3 is a top sectional view of the automatic shoe cover dispenser according to the above preferred embodiment of the present invention.

Referring to FIG. 1, FIG. 2 and FIG. 3 of the drawings, the shoe cover pulling mechanism A1 comprises one or more fixed members 8 each being embodied as a hook shaped member firmly mounted on the frame 1, one or more active members 9 each being embodied as a hook shaped member movably mounted on a rack 13 provided in the frame 1. The active member 9 is adapted for moving along the rack 13 and cooperating with the fixed member 8 in such a manner that one of the shoe covers 5 is capable of being placed between the fixed members 8 and the active members 9 and pulling the shoe cover 5 into an open-up condition and being ready for putting on a user's shoe.

The driving mechanism A2 comprises a pedal 17 provided in the frame 1 in such a manner that when the pedal 17 is stepped down, the active members 9 are driven to cooperate with the fixed members 8 to pull out one of the shoe covers 6.

According to the preferred embodiment of the present invention, a pedal shaft 18 is provided and the pedal 17 is pivotally connected with the pedal shaft 18. According to the preferred embodiment of the present invention, the pedal 17 comprises a pair of linkage arms 20 pivotally connected to two end portions of the pedal shaft 18. Moreover, a pair of balance arms 19 is provided between the pedal 17 and the linkage arms 20 for balancing the movement of the petal 17 while it is stepping down to ensure a steady motion for the user. A pair of connecting shells 32 is provided at two end portions of the linkage shaft 31 to ensure the linkage arms 20 being extended in a parallel manner.

Figure 9:
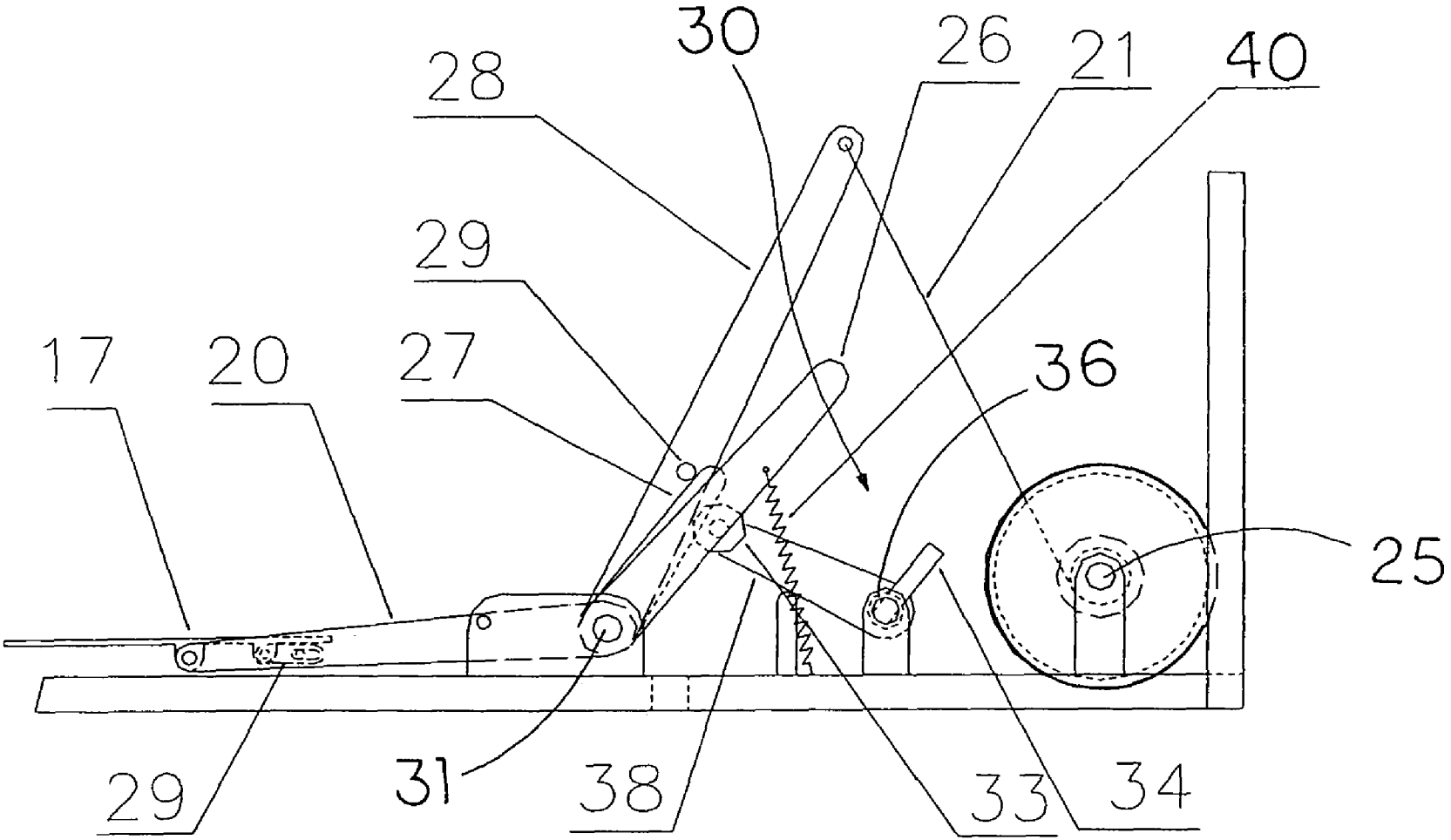
FIG. 9 is a schematic diagram of a working process of a buffer unit of the automatic shoe cover dispenser according to the above preferred embodiment of the present invention, illustrating the locked state of the buffer unit.

A draw bar 26 is pivotally connected with the linkage arms 20 via a linkage shaft 31 in order to link the petal 17 with the draw bar 26. An auxiliary arm 28 has a lower end is pivotally connected to the linkage shaft 31 and is upwardly and inclinedly extended for assisting the movement of the linkage arms 20. Furthermore, a linkage resilient element 40 such as a spring is connected between the draw bar 26 and a bottom of the frame 1 to reserve a resilient force to the draw bar 26 when a downward force is applied to the petal 17 as shown in FIG. 9 for pulling the petal 17 returning to original position when the downward force is released.

The draw bar 26 having a front end and a rear end, a drag unit 21 wound round a wheel unit 200 mounted in the frame 1, wherein the rear end of the draw bar 26 is pivotally connected to the linkage shaft 31 so as to pivotally link with the pedal 17, and the drag unit 21 links the front end of the draw bar 26 with the active members 9 in such a manner that when the pedal 17 is stepped down, the pedal 17 drives the draw bar 26 to drag the drag unit 21 so as to driving the active members 9 linked with the drag unit 21 to move along the racks 13 and cooperating with the fixed members 8 to pull out one of the shoe covers 6.

The shoe cover feeding arrangement A3 comprises a feeding rod 2 upwardly and inclinedly extended in the frame 1, wherein each of the shoe covers 5 comprises a sliding element 3 through which the shoe covers 5 are hanged along the feeding rod 2. According to the preferred embodiment of the present invention, a position plate 4, which is mounted on the feeding rod 2, is placed on top of the shoe covers hanged along the feeding rod 2 for pushing the shoe covers 5 toward the fixed members 8.

According to the preferred embodiment of the present invention as shown in FIG. 3, the pair of racks 13 is provided and each rack 13 is equipped with an elastic member 14 thereon. A sliding member 10 is coupled with each rack 13 and the active members 9 are movably mounted on the racks 13 via the sliding members 10 respectively. And the drag unit 21 also is linked to the active members 9 via the sliding members 10.

Each of the elastic members 14 has a front end extended to the front of the frame 1 and a rear end connected with the respective active member 9 through the sliding member 10. Thus, when the pedal 17 is stepped down, the elastic members 14 are compressed when the active members 9 move to the fixed members 8. When the force applied on the pedal 17 is released, the active members 9 are capable to move back along the racks 13 by means of the force of the compressed elastic members 14. A frame bar 7 is transversely mounted across a middle portion of the frame 1. According to the preferred embodiment of the present invention as shown in FIG. 3, there is a pair of fixed members 8 spacedly and firmly mounted on the frame bar 7.

According to the preferred embodiment of the present invention as shown in FIG. 3, the wheel unit 300 comprises first and second roller wheels 23, 24 coaxially and pivotally connected to a wheel shaft 25 of the frame 1. The first roller wheel 23 has a larger diameter 23 and the second roller wheel 24 has a smaller diameter. The drag unit 21 comprises a rope like first drag element 211 and a rope like second drag element 212 wound round the first roller wheel 23. The first drag element 21 which winds round the second roller wheel 24 is linked to the auxiliary arm 28. The second drag element 22 is linked to the sliding members 10 of the active members 9. When the first drag element 211 drives the second roller wheel 24 to rotate due to the movement of the auxiliary arm 28, the first roller wheel 23 following the rotation of the second roller wheel 24 drives the second drag element 212 to displace. Such that the active members 9 are capable to move in a long way so as to adequately pull out the shoe cover 5 to the standby condition.

The auxiliary arm 28 has a predetermined length which is long enough that when the petal 17 has a certain displacement, the extended end of the auxiliary arm 28 which connects with the first drag element 211 will have a relatively larger movement so as to drive the first drag element 211 to generate a longer displacement.

Figure 5B:
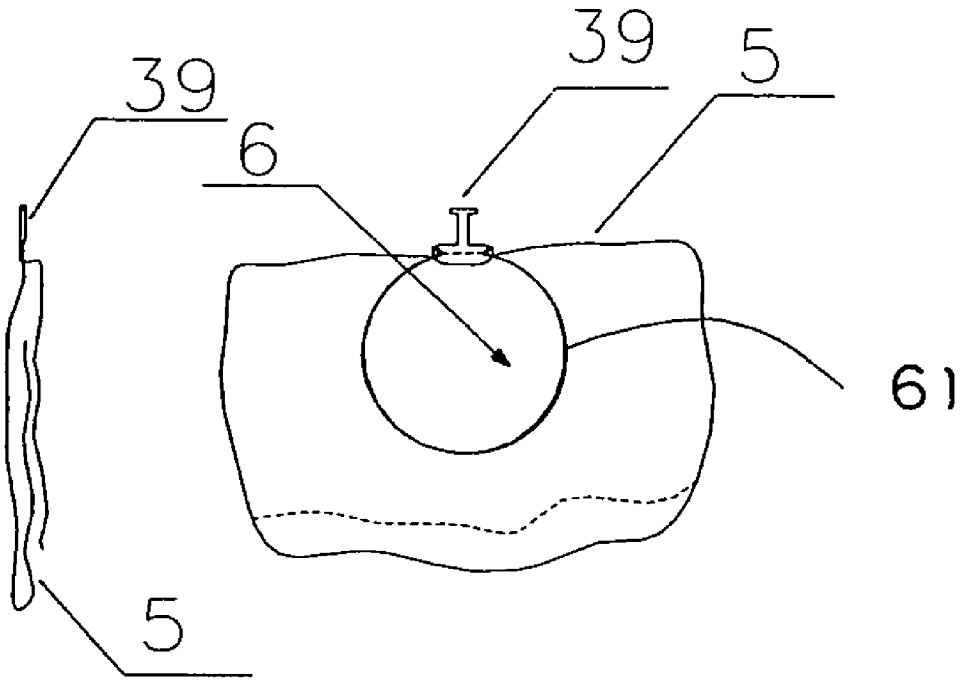
FIG. 5*b* is a perspective view of a shoe cover used the automatic shoe cover dispenser according to the above preferred embodiment of the present invention.
Figure 5A:
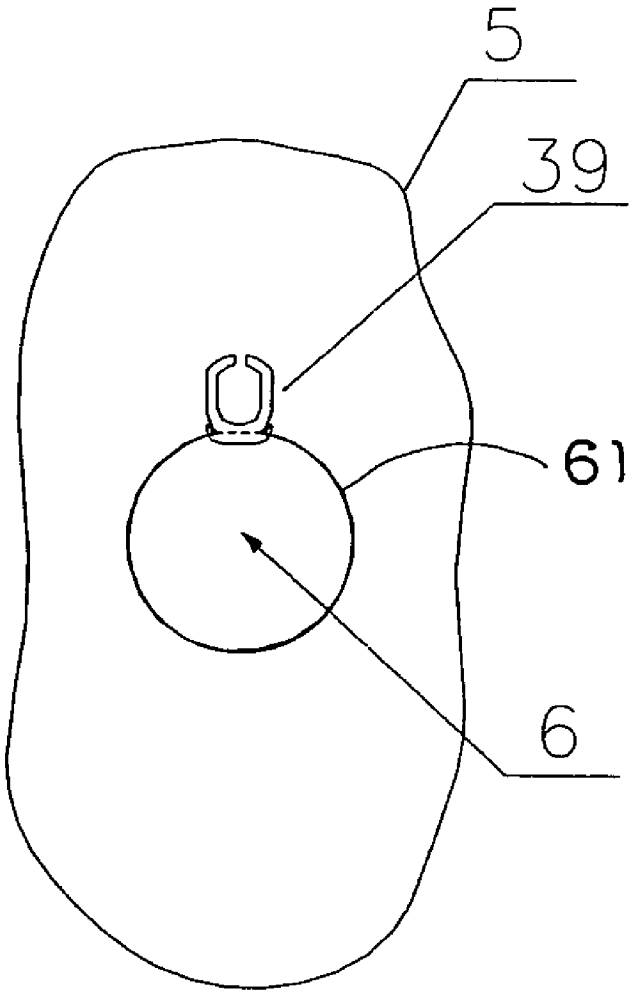
FIG. 5*a* is a perspective view of an original shoe cover before used in the automatic shoe cover dispenser according to the above preferred embodiment of the present invention.

Referring to FIG. 5*a* and FIG. 5*b* of the drawings, the shoe cover 5 is made of durable, soft and/or elastic material, such as soft plastic. Each of the shoe covers 5 is constructed in a pocket structure adapted to wrap up a user's shoe, as shown in FIG. 5*a*, wherein the shoe covers 5 hanged along the feeding rod 2 are arranged in the standby condition, as shown in FIG. 5*b*. The shoe opening 6 has an elastic peripheral edge 61 providing an elastic effect by means of, for example, an elastic cord affixed around the circumference of the shoe opening 6 such that the shoe cover 5 is adapted to being pulled out to the standby condition. Each of the shoe covers 5 further comprises a holding member 39 provided adjacent to the shoe opening 6 thereof in such a manner that the shoe cover 5 is capable to being hanged on the feeding rod 2 through the holding member 39.

Figure 4A:
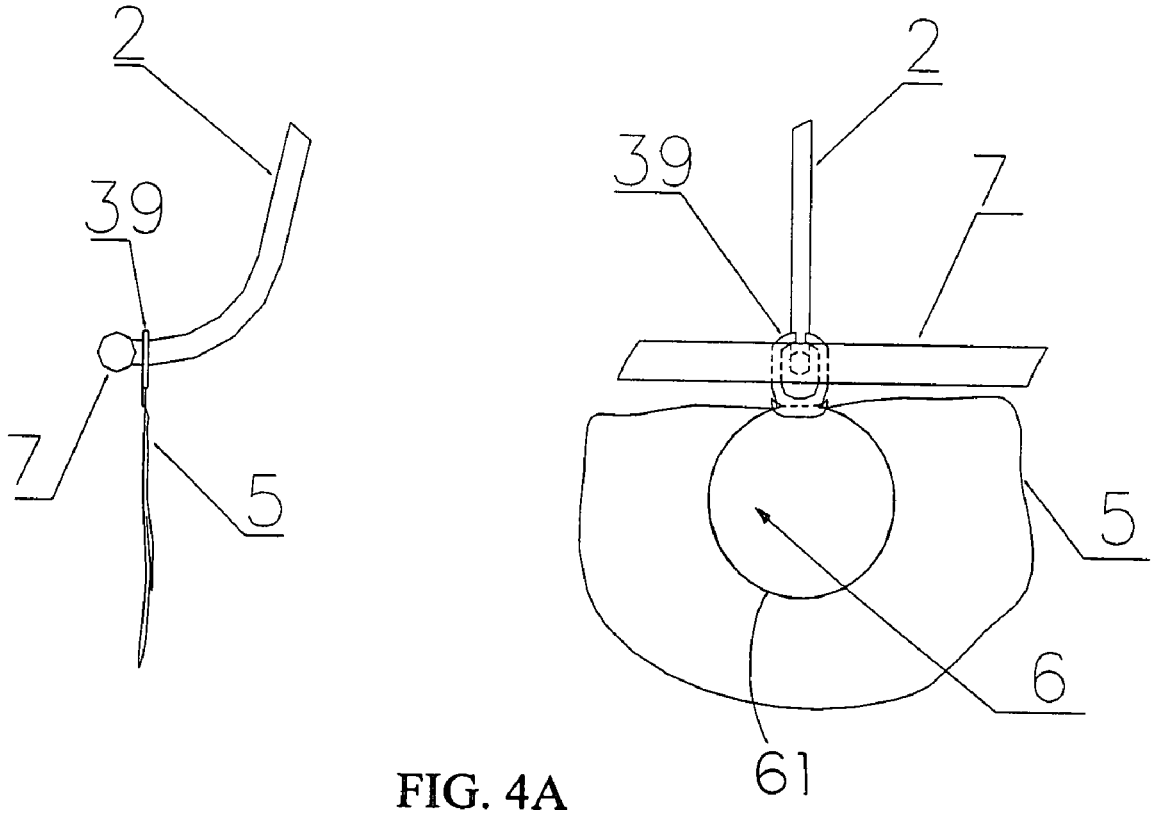
FIG. 4*a* is a perspective view of a shoe cover bar of the automatic shoe cover dispenser according to the above preferred embodiment of the present invention.
Figure 4B:
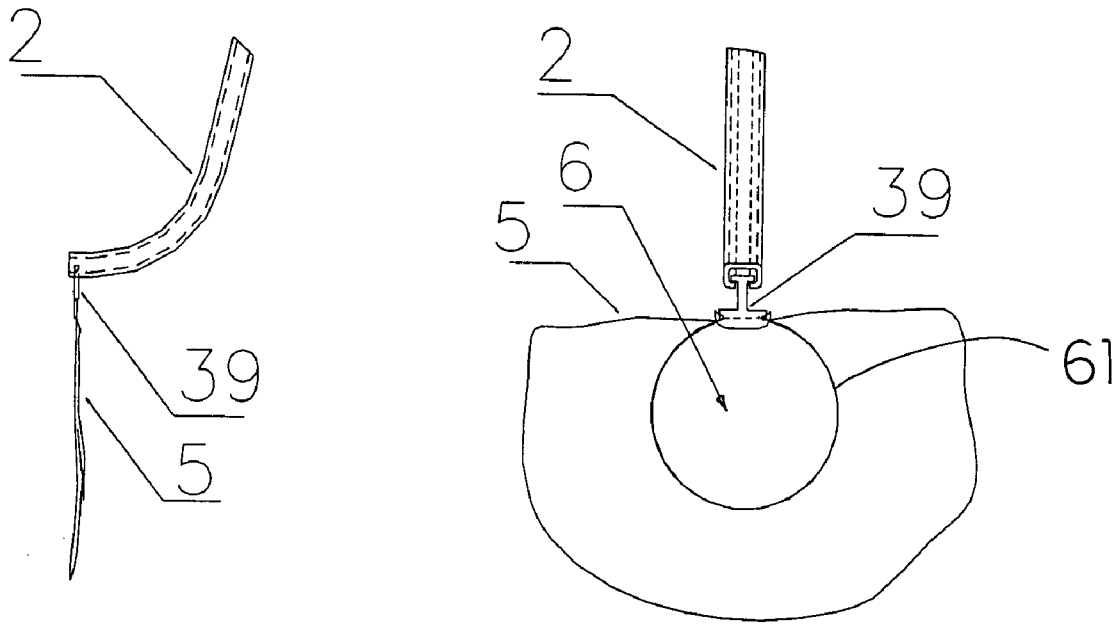
FIG. 4*b* is a perspective view illustrating another alternative mode of the automatic shoe cover dispenser according to the above preferred embodiment of the present invention.

It is appreciated that there are various alternative modes of connection relation between the shoe covers 5 and the feeding rod 2. According to the present invention, two different embodiments of the shoe covers 5 are illustrated to comply with different modes of feeding rod 2. Accordingly, two types of holding member 39 are embodied and illustrated in the preferred embodiment of the present invention, as illustrated in FIGS. 4*a* to 5*b*, for connecting with the feeding rod 2. As shown in FIGS. 4*a* and 5*a* of the drawings, the feeding rod 2 has a circular cross-section, the connecting part of the holding member 39 has a ring shape correspondingly to mating with the feeding rod 2. In another alternative mode of the connection relations between the shoe cover 5 and the feeding rod 2, as shown in FIGS. 4*b* and 5*b* of the drawings, the feeding rod 2 is a hollow rod and the connecting part of the holding member 9 is in a "T" shape correspondingly to mating with the feeding rod 2.

Figure 7:
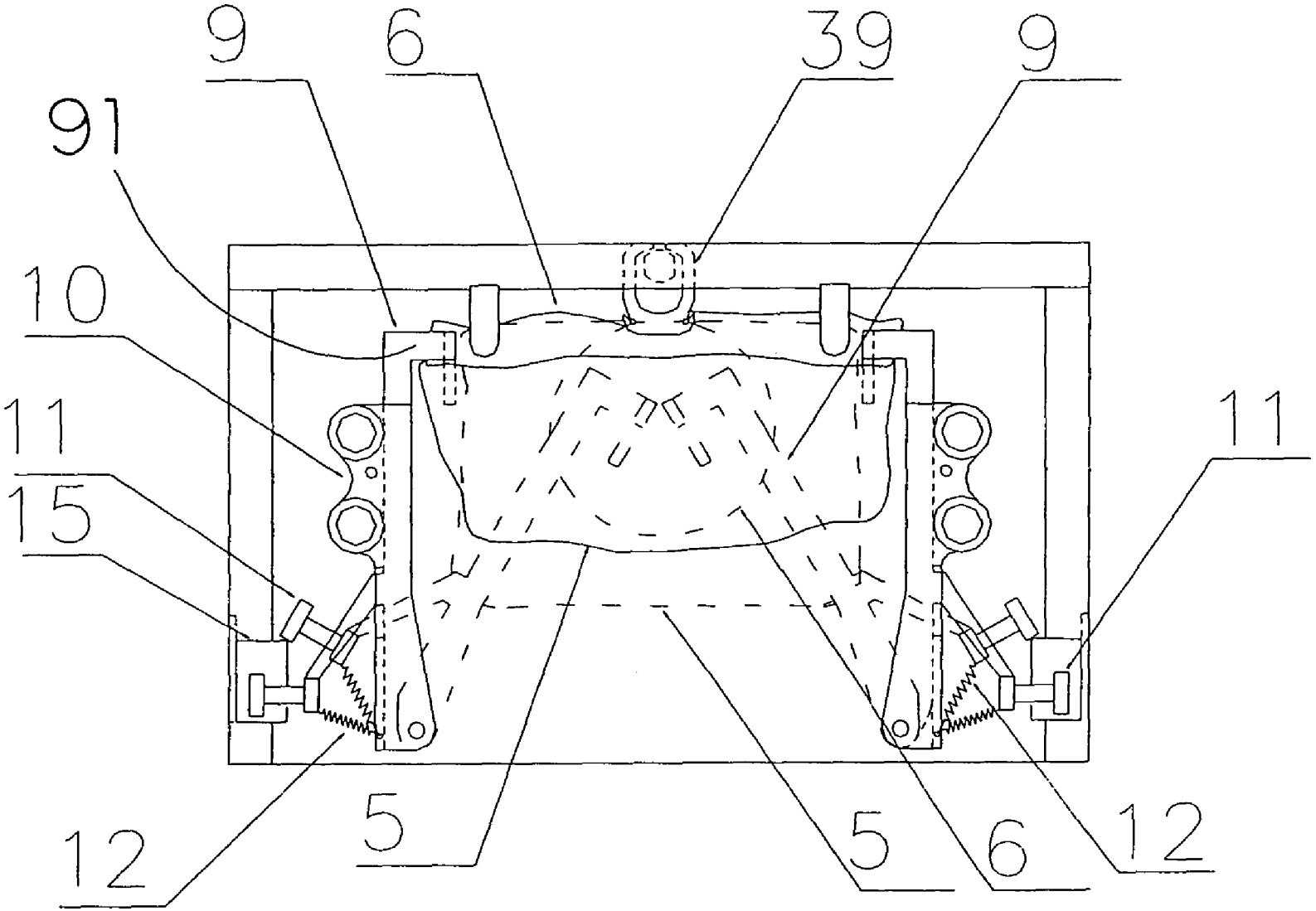
FIG. 7 is a schematic diagram of the above working process of the automatic shoe cover dispenser according to the above preferred embodiment of the present invention, illustrating the hitch process about an active member cooperated with a fixed member to hitch shoe opening of a shoe cover.

Referring to the FIG. 7 of the drawings, the shoe cover pulling mechanism A1 comprises a pair of sliding guides 15 mounted on the frame 1. The active members 9, mounted on the sliding members 10 in a pin joint manner. Each of the active members 9 comprises a clasping element 91 which is a crook structure on a top end thereof for clasping the shoe opening 6 of the shoe cover 5 and a bearing 11 with a reset unit 12 such as spring provided on a lower end thereof.

When the active members 9 and the sliding members 10 are driven by the second drag element 212 to overcome the resilient force of the elastic members 14 and reserve an elastic energy and to move to the fixed members 8 along the racks 13, the bearings 11 with the reset units 12 of the active members 9 slide along the sliding guides 15 so as to render the active members 9 to move downwardly, wherein the clasping elements 91 move inwardly to enable the clasping elements, i.e. the crook structures, of the active members 9 to adequately contact and effectively pull out the shoe opening 6 of the respective shoe cover 5 to the open-up condition. According to the preferred embodiment of the present invention, each of the sliding guides 15 is mounted on the frame 1 through a sliding guide shaft 16 provided in the frame 1.

Figure 8:
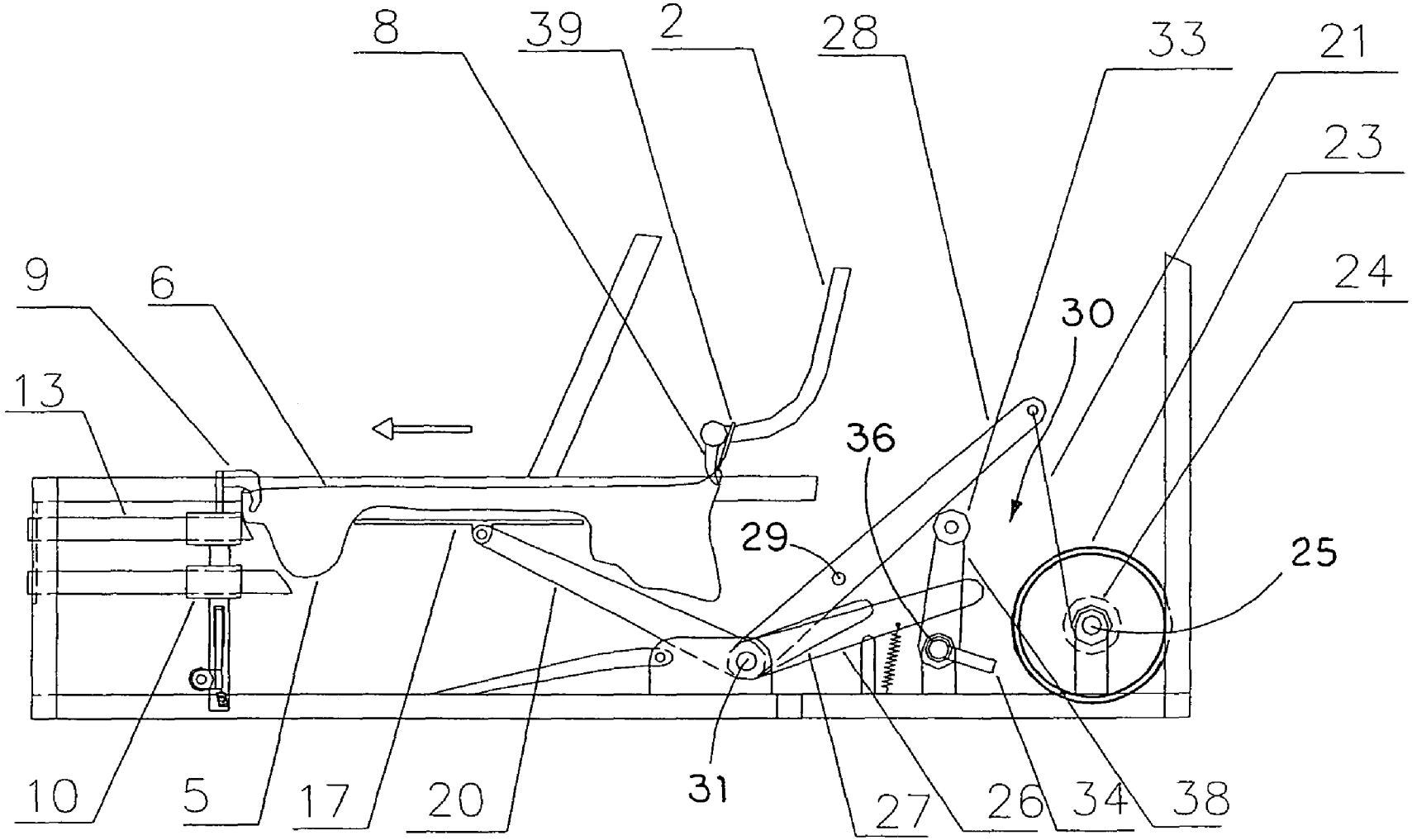
FIG. 8 is a schematic diagram of the above working process of the automatic shoe cover dispenser according to the above preferred embodiment of the present invention, illustrating the pull process about the active member cooperated with the fixed member to pull out shoe opening of a shoe cover into an unwrapped manner.
Figure 10:
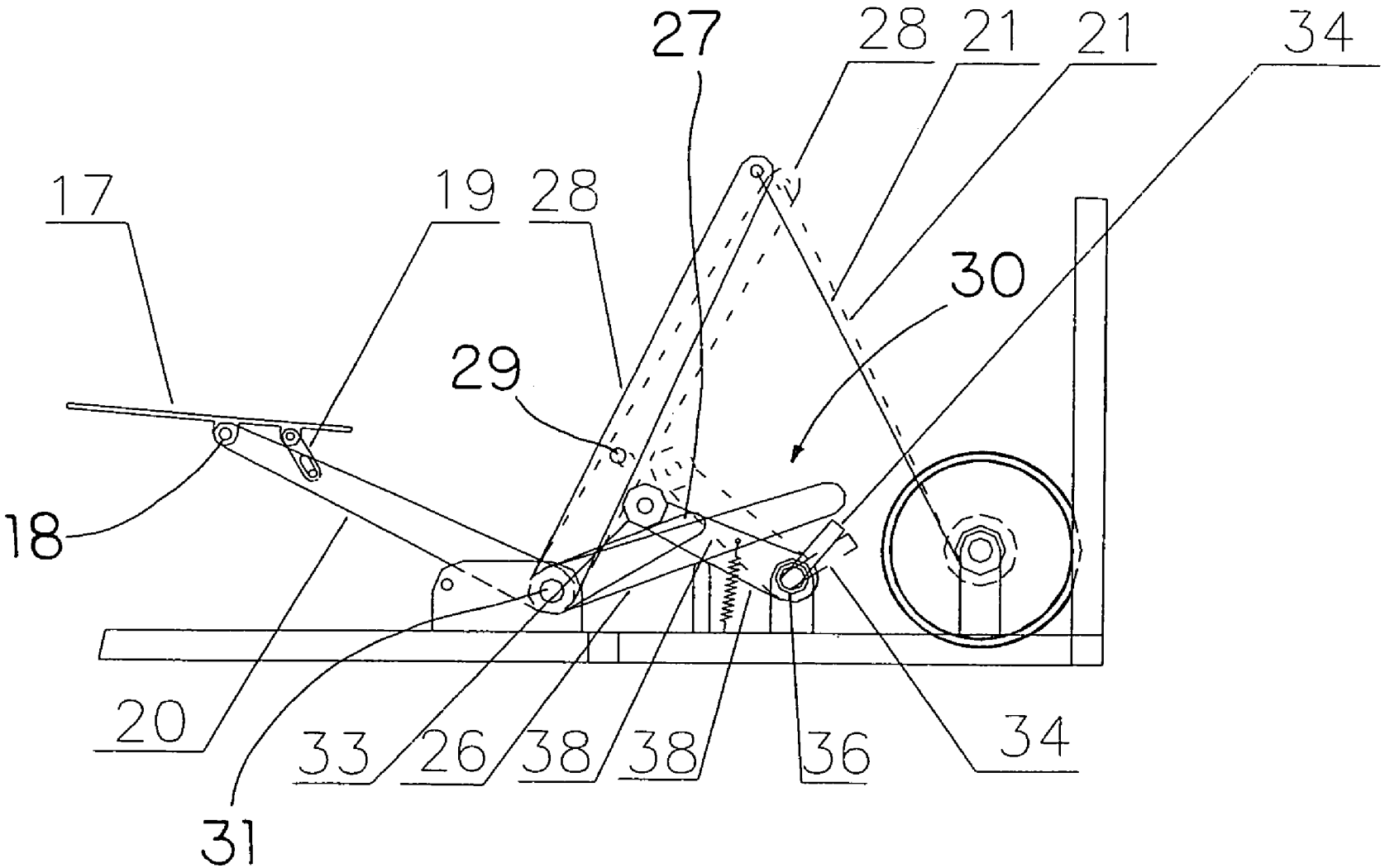
FIG. 10 is a schematic diagram of a working process of a buffer unit of the automatic shoe cover dispenser according to the above preferred embodiment of the present invention, illustrating the unlocked state of the buffer unit.

According to the preferred embodiment of the present invention, referring to FIGS. 8 to 10 of the drawings, the automatic shoe cover dispenser further comprises a buffer unit 30 provided in the frame 1. The buffer unit 30 comprises a driving arm 27 pivotally connected to the linkage shaft 31 so as to linked with the pedal 17, a buffer arm 38 having a buffer bearing 33 provided at an upper end thereof being pivotally mounted to the frame 1, and a resilient element 36 mounted on the buffer arm 38.

The driving arm 27 drives the buffer arm 38 rotating and displacing to a position that the buffer arm 38 with the buffer bearing 33 and the draw bar 26 are in a tangency manner. Therefore, the buffer unit 30 is adapted for making the draw bar 26 standing in a temporary stillness state so as to avoid the active members 9 timely draw back along the racks 13 under the force of the elastic members 14 so that the user will have enough time to remove his/her feet from the pedal 17 of the automatic shoe cover dispenser.

The auxiliary arm 28 has a linkage pin 29 provided thereon, wherein the driving arm 27 works with the linkage pin 29 when it is rotating so as to assist the auxiliary arm's rotation movement.

According to the preferred embodiment of the present invention, the buffer unit further comprises a buffer pin 34 provided on the buffer arm 38, wherein the buffer arm 28 mounted on the frame 1 via a buffer shaft 35. Furthermore, a banking block 37 is mounted on the frame 1 adapted for limiting the overage shift of the buffer arm 38.

As a result, referring to FIG. 6, FIG. 7, FIG. 8, FIG. 9 and FIG. 10 of the drawings, according to the preferred embodiment of the present invention, a working process of the automatic shoe cover dispenser is illustrated.

Figure 6:
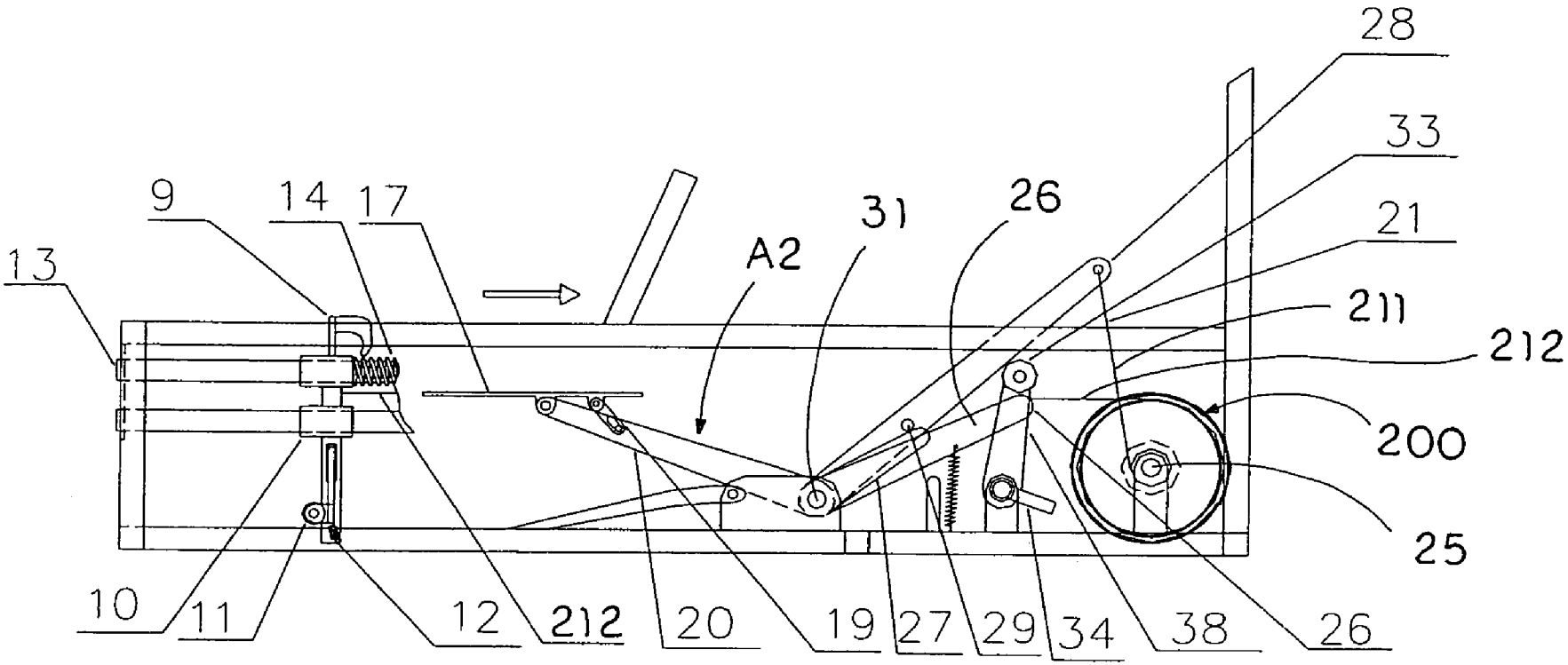
FIG. 6 is a schematic diagram of a working process of the automatic shoe cover dispenser according to the above preferred embodiment of the present invention, illustrating the original state of working process of the present invention.

A plurality of shoe covers 5 is previously placed at the feeding rod 2, wherein the shoe opening 6 of the shoe cover 5 faces to the active member 9. Then, install the position plate 4 to the feeding rod 2 to place and push on top of the stack of shoe covers 5. Following a downward movement of the pedal 17 when a force applied thereon, as shown in FIG. 6 of the drawings, the linkage arms 20, the draw arm 26 and the driving arm 27 displace accordingly at the same time. Then, the driving arm 27 drives the auxiliary arm 28 to move upwards through the linkage pin 29 so as to pull the first drag element 211 to drive the first and second roller wheels 23, 24 to rotate, wherein through the second drag element 212, the first roller wheel 23 drives the sliding members 10 to move towards fixed members 8 along the racks 13, so that the active members 9 follow the sliding members 10 to move simultaneously to compress the elastic members 14.

When the pedal 17 is continuously stepped down, the active members 9 continuously move towards the fixed members 8 and, at the same time, the sliding guides 15 will be lifted up to compress the reset units 12 while the clasping elements 91 of the active members 9 are driven to move towards each other to form a close-up condition, wherein when the active members 9 are moved to a position behind the fixed members 8, the active members 9 enter the shoe opening 6 of one of the shoe covers 5.

During the downward movement of the pedal 17 which is continuously stepped downwardly to a lowest position, the active members continuously move and drive the bearings 11 to move to the ends of the sliding guides 15 until departing from the control of the sliding guides 15. At this moment, bearings 11 are driven downwardly to return to their original position by means of the reset units 12 and thus driving the active members 9 to move apart from each other to form an open-up condition, in which since the clasping elements 91 of the active members 9 enter the respective shoe cover 5 through the shoe opening 6 at this moment, the clasping elements 91 of the active members 9 clasp against the elastic peripheral edge 61 of the shoe opening 6 and open up the shoe opening 6 while the active members 9 moving apart from each other, as shown in FIG. 7.

At this moment, since the pedal 17 is stepped to a lowest position, the auxiliary arm 28 is driven accordingly to a highest position, during the upward rotating movement of the auxiliary arm 28, the buffer arm 38 moves upwards simultaneously through the resilient element 36. When the auxiliary arm 28 is upwardly moved to the highest position, the buffer arm 38 moves, at the same time, to the banking block 37 while the buffer bearing 33 in contact with a lower side of the auxiliary arm 28, so that the buffer arm 38 presses against the auxiliary arm 28 so as to support the auxiliary arm 28 from moving downwards to its original position simultaneously when the downward force applied to the pedal 17 is released, as shown in FIG. 9.

After the stepping down process of the pedal 17 as described above is completed, lift up the user's foot which previously applied the downward force to the pedal 17, the downward force applied to the pedal 17 is released and the pedal 17 will moves upwards to its original upper position due to the spring action of the linkage resilient element 40. At the same time, the linkage arms 20, the draw bar 26 and the driving arm 27 start to rotate back to their original positions while the buffer bearing 38 pushing against the auxiliary arm 28 so as to support the auxiliary arm 28 from being rotated downwardly simultaneously. Thus, there is also no displacement for the first drag element 211 so that during the pedal 17 starts to be lifting up of the pedal 17 to its original position, the first and second roller wheels 23, 24 and the active members 9 will remain in their still condition. Therefore, the user may easily lift his or her foot from the pedal 17.

When the pedal 17 moves to its highest position, the draw bar 26 rotates downwardly to its lowest position and hits the buffer pin 34. Since the buffer pin 34 and the buffer arm 38 are affixed to the buffer shaft 35, the buffer pin 34 overcomes the pulling force of the resilient element 36 and rotates downwardly due to the impact of the draw bar 26 so that the contact condition between the auxiliary arm 28 and the buffer arm 38 and the buffer bearing 33 will change accordingly and return to their original condition. Also, the limitation of the auxiliary arm 28 by the buffer bearing 33 is released and the auxiliary arm 28 starts to rotate downwardly by means of the elastic members 14, as shown in FIG. 10. At the same time, the first and second roller wheels 23, 24 start to rotate to their original position simultaneously and the active members 9 starts to move backwards to their original position under the spring action of the elastic members 14.

At this moment, since the clasping elements 91 of the active members 9 are clasped with the elastic peripheral edge 61 of the shoe opening 6 of the respective shoe cover 5, the active members 9 will drive the elastic peripheral edge 61 of the shoe opening 6 of the shoe cover 5 to move backwards. During such motion, since the fixed members 8 are located at a middle portion of the elastic peripheral edge 61 of the shoe opening 6 when the shoe opening 6 is which is enlarged by the active members 9 in the open-up condition, the fixed members 8 will hook on the upper side of the elastic peripheral edge 61 of the shoe opening 6 so as to render the elastic peripheral edge 61 of the shoe opening 6 separates from the clasping of the clasping elements 91 of the active members 9 while the lower side of the elastic peripheral edge 61 of the shoe opening 6 remains clasping by the clasping elements 91 of the active members 9 to move backwards, so that the shoe opening 6 is pulled to open accordingly.

Moreover, the sliding guides 15 are movably mounted on the frame 1 by means of the sliding guide shafts 16 to provide a one-way guiding ability so that, during the backward movement of the active members 9, the bearings 11 will not be limited by the sliding guides 15. In order words, during the backward pulling and opening procedures of the shoe opening 6 as described above, the active members 9 is ensured to remain in the open-up condition under the spring effect of the reset units 12 until they are return to their original position, as shown in FIG. 8, and thus the shoe opening 6 is completely opened up.

Since the pedal 17 is positioned below the shoe cover 5 with its shoe opening being opened, when the user place and step on the pedal 17 again, the stepping down of the shoe cover 5 will drive the elastic peripheral edge 61 of the shoe opening 6 downwards to separate from the active members 9 and the fixed members 8 while the holding member 39 is pressed to separate from the feeding rod 2 at the same time. Thus the shoe cover 5 will wrap over the user's shoe stepped on the pedal 17 to complete the wearing process of the shoe cover 5. Also, in this stepping process, the repeated downward stepping actions of the pedal 17 will drive the active members 9, the linkage arms 20, draw arm 26, the driving arm 27, the auxiliary arm 28, the first and second roller wheels 23, 24, the first and second drag elements 211, 212, and the buffer arm 38 will process the above actions repeatedly so as to accomplish the wearing of the shoe cover 5 on the user's shoe repeatedly simply by stepping on the pedal 17.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatic shoe cover dispenser, comprising:

a shoe cover feeding arrangement holding a plurality of shoe covers each having a shoe opening;

a pulling mechanism which is capable of pulling one of said shoe covers from said shoe cover feeding arrangement as a standby shoe cover for being ready for wearing on a shoe of a user; and a driving mechanism, comprising a pedal arranged in up and down movable manner for said shoe of said user to step thereon and means for driving said pulling mechanism to deliver said standby shoe cover to said pedal and enlarging said shoe opening of said standby shoe cover to be large enough for said shoe of said user to place inside said standby shoe cover by means of up and down movements of the pedal, wherein said shoe opening of each of said shoe cover has an elastic peripheral edge provided therearound, wherein said driving mechanism is constructed in a manner that when a downward force is applied to said pedal to press said pedal downward, said pulling mechanism is actuated to deliver said standby shoe cover above said pedal and said shoe opening is enlarged by applying a separating force to move said elastic peripheral edge apart by said driving mechanism, afterward said pedal being driven upwards again by said driving mechanism, wherein when said pedal is pressed downward again, said standby shoe cover is detached from said shoe cover feeding arrangement and said separating force applied to said elastic peripheral edge is released by means of said driving mechanism for wearing said standby shoe cover on said shoe of said user that steps on said pedal to press said pedal to move up and down.

2. The automatic shoe cover dispenser, as recited in claim 1, further comprising a frame, wherein said pulling mechanism comprises one or more fixed members, one or more active members each movably mounted on a rack provided in said frame, wherein said active members are arranged to be moved along said racks respectively and cooperating with said fixed member in such a manner that said standby shoe cover is capable of being placed between said fixed members and said active members and pulling said standby shoe cover into an open-up condition and being ready for wearing on said shoe of said user stepped on said pedal.

3. The automatic shoe cover dispenser, as recited in claim 2, wherein said pedal is movably supported in said frame in such a manner that when said pedal is pressed to move downwards, said active members are driven to cooperate with said fixed members to pull out said standby shoe cover of said shoe cover.

4. The automatic shoe cover dispenser, as recited in claim 3, wherein said pedal of said driving mechanism further comprises a pedal shaft pivotally connected said pedal to said frame and at least one linkage arm pivotally connected to said pedal shaft, wherein said means of said mechanism further comprises a draw bar pivotally connected with said linkage arm via a linkage shaft in order to link said petal with said draw bar, an auxiliary arm having a lower end pivotally connected to a linkage shaft and is upwardly and inclinedly extended for assisting said movement of said linkage arm, a linkage resilient element connected between said draw bar and a bottom of said frame to reserve a resilient force to said draw bar when said downward force is applied to said petal for pulling said petal returning to an original position thereof when said downward force is released.

5. The automatic shoe cover dispenser, as recited in claim 4, wherein said means of said driving mechanism further comprises a drag unit wound round a wheel unit mounted in said frame, wherein a rear end of said draw bar is pivotally connected to said linkage shaft so as to pivotally link with said pedal, and said drag unit links a front end of said draw bar with said active members in such a manner that when said pedal is stepped down, said pedal drives said draw bar to drag said drag unit so as to driving said active members linked with said drag unit to move along said racks and cooperating with said fixed members to pull out said standby shoe cover of said shoe covers.

6. The automatic shoe cover dispenser, as recited in claim 1, wherein said shoe cover feeding arrangement comprises a feeding rod upwardly and inclinedly extended in said frame, wherein each of said shoe covers comprises a sliding element through which said shoe covers are hanged along said feeding rod.

7. The automatic shoe cover dispenser, as recited in claim 6, wherein a position plate mounted on said feeding rod is placed on top of said shoe covers hanged along said feeding rod for pushing said shoe covers toward said fixed members.

8. The automatic shoe cover dispenser, as recited in claim 5, wherein said shoe cover feeding arrangement comprises a feeding rod upwardly and inclinedly extended in said frame, wherein each of said shoe covers comprises a sliding element through which said shoe covers are hanged along said feeding rod.

9. The automatic shoe cover dispenser, as recited in claim 8, wherein a position plate mounted on said feeding rod is placed on top of said shoe covers hanged along said feeding rod for pushing said shoe covers toward said fixed members.

10. The automatic shoe cover dispenser, as recited in claim 8, wherein each of said racks is equipped with an elastic member thereon and a sliding member is coupled with each of said racks and said active members are movably mounted on said racks via said sliding members respectively, wherein said drag unit is linked to said active members via said sliding members.

11. The automatic shoe cover dispenser, as recited in claim 10, wherein each of said elastic members has a front end extended to a front of said frame and a rear end connected with said respective active member through said sliding member, wherein when said pedal is pressed down, said elastic members are compressed when said active members move to said fixed members, wherein when said downward force applied on said pedal is released, said active members are capable to move back along said racks by means of said force of said compressed elastic members, wherein a frame bar is transversely mounted across said frame and said fixed members are spacedly and firmly mounted on said frame bar.

12. The automatic shoe cover dispenser, as recited in claim 11, wherein said wheel unit comprises first and second roller wheels coaxially and pivotally connected to a wheel shaft of said frame, wherein said first roller wheel has a larger diameter and said second roller wheel has a smaller diameter, wherein said drag unit comprises a first drag element and a second drag element wound round said first roller wheel, wherein said first drag element which winds round said second roller wheel is linked to said auxiliary arm, wherein said second drag element is linked to said sliding members of said active members, wherein when said first drag element drives said second roller wheel to rotate due to said movement of said auxiliary arm, said first roller wheel following said rotation of said second roller wheel drives said second drag element to displace.

13. The automatic shoe cover dispenser, as recited in claim 12, wherein said auxiliary arm has a predetermined length which is long enough that when said petal has a certain displacement, said extended end of said auxiliary arm which connects with said first drag element has a relatively larger movement so as to drive said first drag element to generate a longer displacement.

14. The automatic shoe cover dispenser, as recited in claim 1, wherein each of said shoe covers further comprises a holding member provided adjacent to said shoe opening thereof in such a manner that said shoe cover is capable to being hanged on said feeding rod through said holding member.

15. The automatic shoe cover dispenser, as recited in claim 13, wherein each of said shoe covers further comprises a holding member provided adjacent to said shoe opening thereof in such a manner that said shoe cover is capable to being hanged on said feeding rod through said holding member.

16. The automatic shoe cover dispenser, as recited in claim 13, wherein said pulling mechanism comprises a pair of sliding guides mounted on said frame, wherein said active members are mounted on said sliding members in a pin joint manner and each of said active members comprises a clasping element on a top end thereof for clasping said shoe opening of said shoe cover and a bearing with a reset unit provided on a lower end thereof.

17. The automatic shoe cover dispenser, as recited in claim 16, wherein when said active members and said sliding members are driven by said second drag element to overcome said resilient force of said elastic members and reserve an elastic energy and to move to said fixed members along said racks, said bearings with said reset units of said active members slide along said sliding guides so as to render said active members to move downwardly, wherein said clasping elements move inwardly to enable said clasping elements of said active members to adequately contact and effectively pull out said shoe opening of said standby shoe cover to said open-up condition.

18. The automatic shoe cover dispenser, as recited in claim 17, wherein said driving mechanism further comprises a buffer unit which comprises a driving arm pivotally connected to said linkage shaft so as to linked with said pedal, a buffer arm having a buffer bearing provided at an upper end thereof being pivotally mounted to said frame, and a resilient element mounted on said buffer arm.

19. The automatic shoe cover dispenser, as recited in claim 18, wherein said driving arm drives said buffer arm rotating and displacing to a position that said buffer arm with said buffer bearing and said draw bar are in a tangency manner, wherein said buffer unit is adapted for making said draw bar standing in a temporary stillness state so as to avoid said active members timely draw back along said racks under said force of said elastic members to enable said user to have enough time to remove said shoe from said pedal.

20. The automatic shoe cover dispenser, as recited in claim 19, wherein said auxiliary arm has a linkage pin provided thereon, wherein said driving arm works with said linkage pin when it is rotating so as to assist said auxiliary arm's rotation movement, wherein said buffer unit further comprises a buffer pin provided on said buffer arm, wherein said buffer arm mounted on said frame via a buffer shaft, wherein a banking block is mounted on said frame adapted for limiting an overage shift of said buffer arm.

* * * * *